US006371753B1

(12) United States Patent
O'Donnell et al.

(10) Patent No.: US 6,371,753 B1
(45) Date of Patent: Apr. 16, 2002

(54) GAS BURNER

(75) Inventors: Michael J. O'Donnell, Rocky River; Terrance C. Slaby, North Royalton; Frank T. Szucs, Jr., Brunswick, all of OH (US)

(73) Assignee: Beckett Gas, Inc., North Ridgeville, OH (US)

( * ) Notice: Subject to any disclaimer, the term of this patent is extended or adjusted under 35 U.S.C. 154(b) by 0 days.

(21) Appl. No.: 09/246,483

(22) Filed: Feb. 9, 1999

Related U.S. Application Data

(60) Provisional application No. 60/074,401, filed on Feb. 11, 1998.

(51) Int. Cl.[7] ..... F23D 14/10

(52) U.S. Cl. ..... 431/125; 431/354; 239/432

(58) Field of Search ..... 126/512; 431/125, 431/154, 354, 346, 353, 355; 239/432, 427, 419.5

(56) References Cited

U.S. PATENT DOCUMENTS

| | | | | |
|---|---|---|---|---|
| 2,591,235 A | | 4/1952 | Cartter | |
| 3,259,003 A | | 7/1966 | Griffin | |
| 3,540,258 A | | 11/1970 | Branson | |
| 3,580,512 A | * | 5/1971 | Smith et al. | 239/432 |
| 3,844,707 A | * | 10/1974 | Wormser | 431/353 |
| 3,874,839 A | * | 4/1975 | Riehl | 431/354 |
| 4,346,845 A | * | 8/1982 | Meyerhoff et al. | 431/354 |
| 4,418,456 A | * | 12/1983 | Riehl | 431/354 |
| 4,726,351 A | | 2/1988 | Whitaker et al. | |
| 4,930,490 A | | 6/1990 | Allan | |
| 4,951,880 A | | 8/1990 | Riehl | |
| 4,971,031 A | | 11/1990 | Richardson | |
| 4,976,253 A | | 12/1990 | Beal et al. | |
| 5,052,370 A | | 10/1991 | Karabin | |
| 5,069,200 A | | 12/1991 | Thow et al. | |
| 5,081,981 A | | 1/1992 | Beal | |
| 5,114,336 A | | 5/1992 | Karabin et al. | |
| 5,320,520 A | | 6/1994 | Barth et al. | |
| 5,328,356 A | | 7/1994 | Hawkinson | |
| 5,336,082 A | | 8/1994 | Riehl | |
| 5,392,763 A | | 2/1995 | Shaw et al. | |
| 5,399,084 A | | 3/1995 | McCullough et al. | |
| 5,584,680 A | | 12/1996 | Kim | |
| 5,601,073 A | | 2/1997 | Shimck | |
| 5,647,341 A | | 7/1997 | Langman et al. | |

* cited by examiner

*Primary Examiner*—Sara Clarke
(74) *Attorney, Agent, or Firm*—Watts, Hoffmann, Fisher, & Heinke Co.

(57) ABSTRACT

A gas burner that produces a yellow flame for use in a fireplace assembly, including front and rear non-combustible logs and a cross-over log supported atop the front and rear logs. The burner includes an elongate, generally tubular sheet metal body having an inlet end, a closed distal end and a tubular segment extending between the ends. The inlet end is formed to define a gas orifice holder which is adapted to mount a gas orifice element and to define at least one primary air opening arranged to admit combustion air into the tubular burner segment. A bluff body is located downstream from the gas orifice element and is positioned such that gas emitted by the orifice impinges on the bluff body. Rows of slot-like flame ports are defined in the tubular segment and are arranged to create a desired predetermined flame pattern and include tabs which determine the effective size of the ports. In regions of the burner located below the crossover log, flame ports are eliminated and/or formed of reduced size, thus providing a flame of lower height and/or less intensity, thus substantially eliminating sooting. In alternate embodiments, the bluff body is formed by a pair of confronting depressions that define a pair of venturi channels which define the mixing chamber. In another embodiment, the confronting depressions are spaced apart and mount a cylindrical bluff element therebetween. The use of venturi channels eliminates or substantially reduces the incidence of light back.

25 Claims, 4 Drawing Sheets

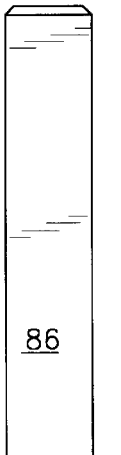
Fig.10
Fig.9
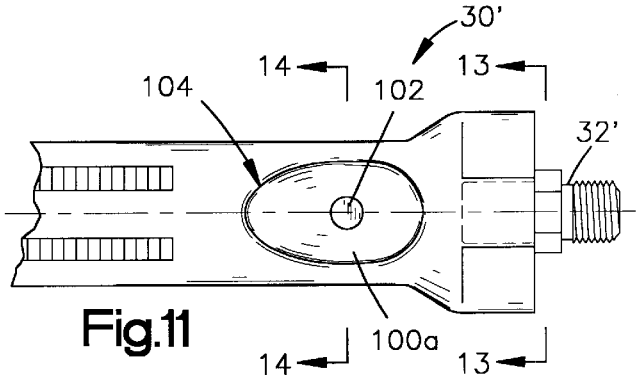
Fig.11
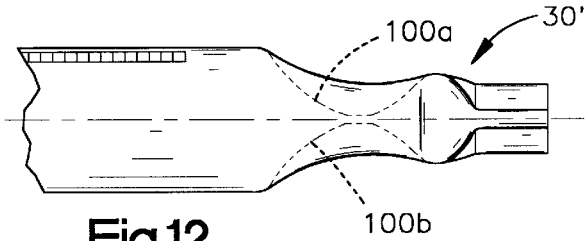
Fig.12
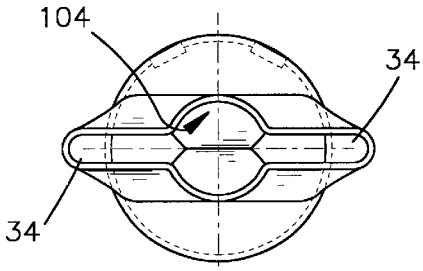
Fig.13
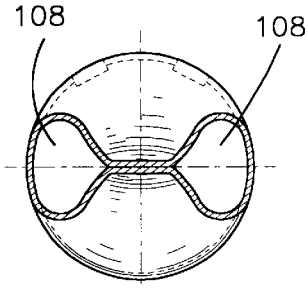
Fig.14
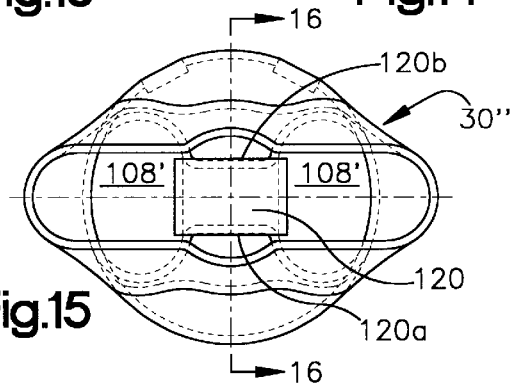
Fig.15
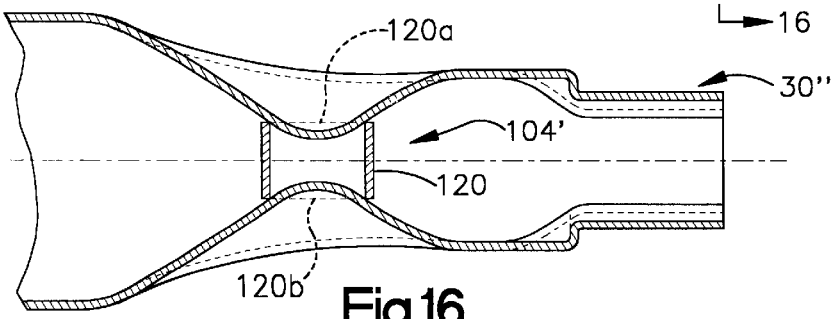
Fig.16

GAS BURNER

This application claims the benefit under 35 U.S.C. § 119(e) of U.S. Provisional application Ser. No. 60/074,401, filed Feb. 11, 1998.

TECHNICAL FIELD

The present invention relates generally to gas burners, and in particular to a gas burner especially adapted to form part of an artificial fireplace and which produces a yellow flame.

BACKGROUND ART

Artificial fireplaces have become very popular with homeowners. These types of fireplaces normally require little if any maintenance and do not produce solid combustion byproducts or waste such as ash.

In order to be aesthetically pleasing to the homeowner, it is desirable that the artificial fireplace simulate an actual wood burning flame as closely as possible. Flames produced by the burning of hydrocarbons such as natural gas, propane, butane, etc., under generally ideal conditions produce a blue flame. A yellow flame is normally produced when inefficient or incomplete combustion of the fuel occurs.

It is desirable to provide a burner for use in an artificial fireplace that produces a yellow flame that simulates an actual log burning fireplace while providing stable and efficient combustion.

DISCLOSURE OF INVENTION

A new and improved gas fireplace burner intended for use with non-combustible log members which produces a yellow flame and no sooting or substantially reduced sooting.

According to the preferred embodiment, the gas fireplace burner, which is intended to burn gaseous fuels, such as natural gas, butane, propane, etc. includes an elongate, generally tubular body having an inlet end and a closed distal end. A tubular segment extends between the ends. In the preferred and illustrated embodiment, the burner body is made from sheet metal, preferably tubular sheet metal, which can be readily formed and shaped. The inlet end of the body is formed to define a gas orifice holder which mounts a gas orifice element. The inlet end is further formed to define at least one combustion air opening which operates to admit combustion air into an interior region of the body.

A bluff body is located downstream from the gas orifice element and is positioned such that gas emitted by the orifice impinges on the bluff body. The bluff body forces the gas to move to either side of the body it and, in so doing, is encouraged to mix with the incoming combustion air.

A series of flame ports are defined by the tubular segment in order to create a desired, predetermined flame pattern. The flame pattern may be dictated in part by the arrangement of the non-combustible log members.

According to a more preferred embodiment, the inlet end of the burner body is formed with a second combustion air opening. The first and second openings are preferably arranged such that the orifice holder is located intermediate the openings.

According to a feature of the invention, the cross-section of the combustion air openings are sized during the forming operation to accommodate the type of gas to be used and/or the gas flow rate sustainable by the gas orifice.

With the disclosed invention, a relatively inexpensive burner for use in artificial fireplaces is provided. The burner can accommodate a wide variety of orifice sizes and gas types. The inlet end, as indicated above, defines the combustion air openings, the size of which are determined during the forming operation. As a consequence, a single burner design can be used with a wide variety of gases and orifice sizes merely by changing the cross-section of the formed inlet end.

The flame ports are formed in the tubular segment of the burner body and, in the preferred embodiment, are arranged in a linear pattern. At least some of the flame ports are slot-like in configuration and have an effective size that is determined by the orientation of a bent tab element that partially defines each of the ports. The ports are preferably formed by a "lancing" operation which utilizes a punch element that pierces the surface of the tubular segment to form the tab that bends downwardly into the burner plenum. The tab is bent downwardly to define an opening in the burner body through which the gas/air mixture is emitted. In the preferred method, the extent to which the punch is driven into the burner body determines the extent to which the port tabs are bent and, hence, the effective size of the port opening. According to the invention, certain areas of the burner may be formed with smaller sized ports in order to produce a smaller flame at that location. For example, flame ports that are located below a "crossing log", i.e., a log that is positioned across and supported atop front and rear non-combustible logs forming part of the fireplace assembly, may be of smaller size.

In the illustrated embodiment, the flame ports are arranged in two or more spaced apart rows of adjacent slot-like openings. In the exemplary embodiment, one row of flame ports extends along a substantial length of the tubular segment. Two other row segments of flame ports are preferably arranged in a parallel relationship with the first row of ports, but are longitudinally spaced with respect to each other. In the preferred embodiment, the first row of ports is segmented and includes a central portion that is formed with smaller flame ports. This disclosed arrangement which includes a first row with a central portion having reduced flame port size coupled with two additional, spaced apart row segments of ports leaves a central region of the burner where the flame is smaller or less intense. This reduced flame in the central region allows a transverse log member to be placed across the front and rear log members used in the fireplace assembly. By providing a lower flame height below the transverse log member, Booting is eliminated, or at the very least, substantially reduced. It should be noted here that the present invention contemplates the provision of reduced size ports at other positions in the tubular body to accommodate the positioning of transverse log members. For example, if two transverse log members are used, rows of ports could be provided with reduced port sizes at opposite ends and/or the elimination of flame ports at end segments of flame port rows. In short, the present invention contemplates using either reduced flame port sizes and/or the elimination of flame ports in certain regions of the burner to provide lower flame height below log members.

The burner is especially adapted to be used in an artificial fireplace which utilizes front and rear spaced apart non-combustible log members supported on a log support, such as a grate. The lower flame present in the central portion of the burner allows a transverse log member to be placed across the front and rear log members. By providing a reduced or smaller flame in the central region of the burner body, sooting on the transverse log member is eliminated or substantially reduced.

According to an alternate embodiment of the invention, the bluff body is formed by a pair of confronting depressions formed near the inlet end of the burner body. The confronting dimples or depressions form a pair of venturi channels that communicate with the combustion air openings and control or effect air entrainment. The dimple defines structure that is in a confronting relationship with the orifice element, so that gas emitted by the element must move to either side of the dimple and through the venturi channels. In so doing, the fuel gas is mixed with the incoming combustion air in proper proportion.

It has been found that the disclosed burner provides a very effective yellow flame producing burner that is especially adapted to be used in artificial fireplaces. Unlike prior art burners of this type, relatively large combustion air openings are provided so that clogging of the air inlet by lint, etc. is inhibited. It has been found that with the disclosed construction, the port nearest the orifice can be at a distance that is less than 2½ times the diameter of the tube, which results in a short mixing chamber, i.e., a relatively short segment of the burner body devoted to receiving and mixing the combustion air with the gas.

Additional features of the invention will become apparent and a fuller understanding obtained by reading the following detailed description made in connection with the accompanying drawings.

BRIEF DESCRIPTION OF DRAWINGS

FIGS. 9 and 10 illustrate the construction of a punching tool that can be used to form the flame ports in the burner;

FIG. 11 illustrates a fragmentary elevational view of an alternate embodiment of the burner;

FIG. 12 is a side view of the alternate embodiment of the burner shown in FIG. 11;

FIG. 13 is a view of the burner as seen from the plane indicated by the line 13—13 in FIG. 11; and FIG. 14 is a cross-sectional view of the burner as seen from a plane indicated by the line 14—14 in FIG. 11;

FIG. 15 is an end view of an alternate embodiment of the burner; and,

FIG. 16 is a sectional view of the alternate burner as seen from the plane indicated by the line 16—16 in FIG. 15.

BEST MODE FOR CARRYING OUT THE INVENTION

Figure 1:
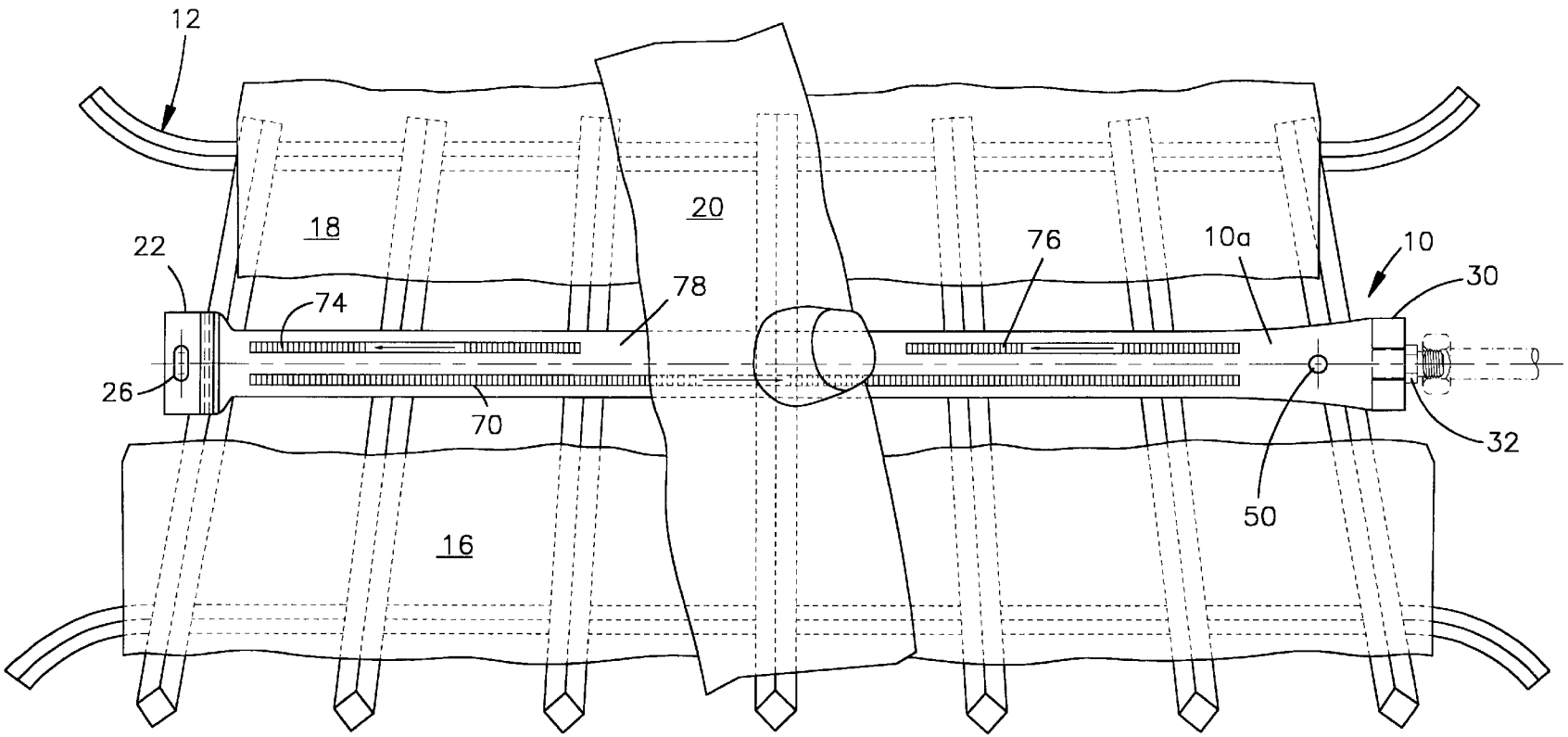
FIG. 1 is a top plan view of a artificial fireplace utilizing the burner of the present invention.

FIG. 1 illustrates one preferred embodiment of a gas burner 10 that is especially adapted to be used in a gas fired, artificial fireplace. In its preferred embodiment, the burner produces a yellow flame that simulates the type of flame seen in a log burning fireplace. As seen in FIG. 1, the gas burner 10 may form part of a fireplace assembly which includes a grate 12 upon which artificial logs are located. In the illustrated embodiment, the gas burner 10 is located between relatively large front and back simulated non-combustible logs 16, 18. A smaller simulated log 20 is supported by the large logs 16, 18 and extends transversely with respect thereto.

Figure 2:
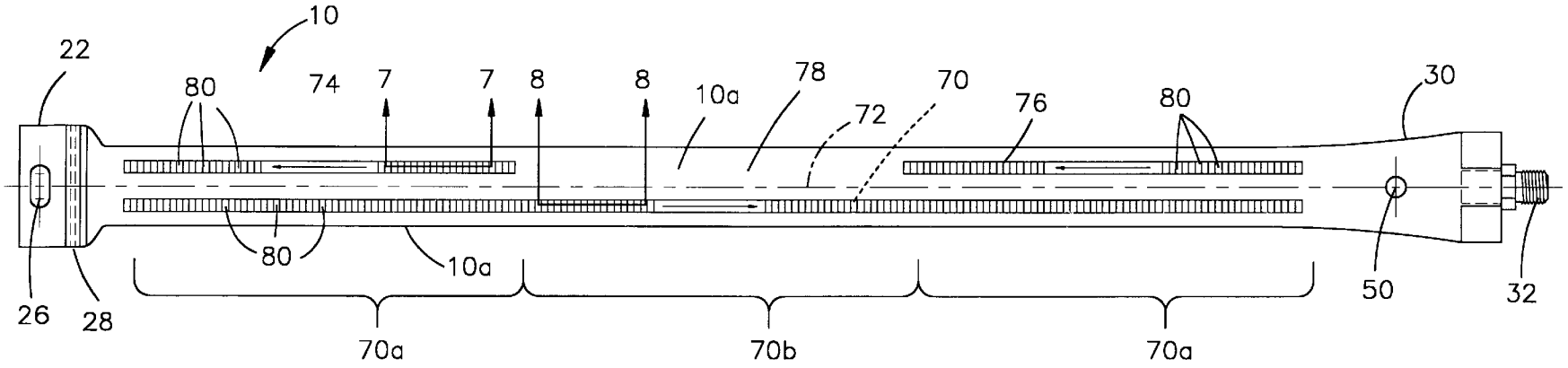
FIG. 2 a top plan view of a burner constructed in accordance with the preferred embodiment of the invention.
Figure 3:
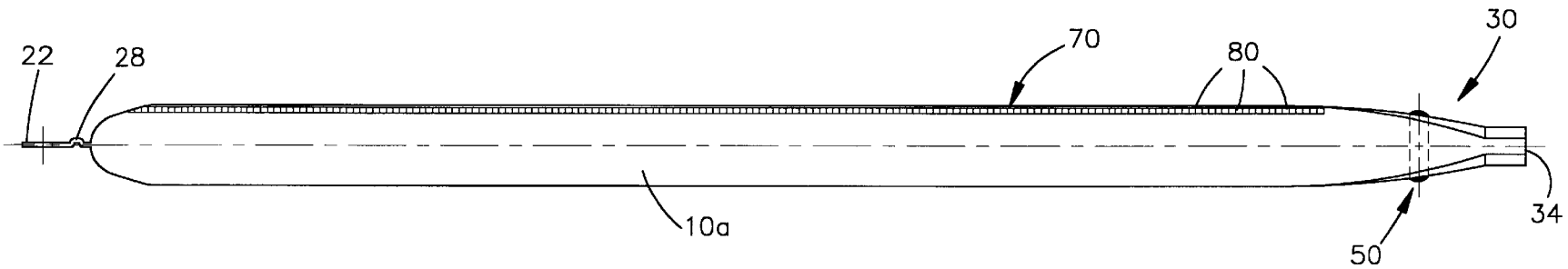
FIG. 3 is a side view of the burner shown in FIG. 2.

Referring also to FIGS. 2 and 3, the gas burner 10 is preferably formed from an elongate tube 10*a*. A distal end 22 is sealed in a crimping operation and defines a closure for a gas tight seal and a mounting flange including a hole or a slot 26. A rigidizing rib 28 is also preferably formed in the mounting flange.

According to the invention, an inlet end 30 of the tube 10*a* defines a mounting for a gas orifice 32, as well as primary air openings 34 (shown in FIG. 4) through which combustion air is admitted into the burner 10. In accordance with the invention, the primary combustion air openings 34 are sized, during manufacture, to accommodate the type of gas that will be used in the fireplace.

Figure 4:
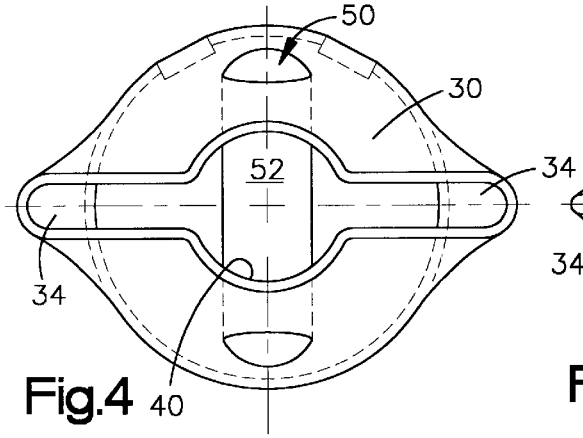
FIGS. 4–6 are end views of the gas burner showing alternate configurations for the inlet end of the burner to accommodate various gaseous fuels.
Figure 5:
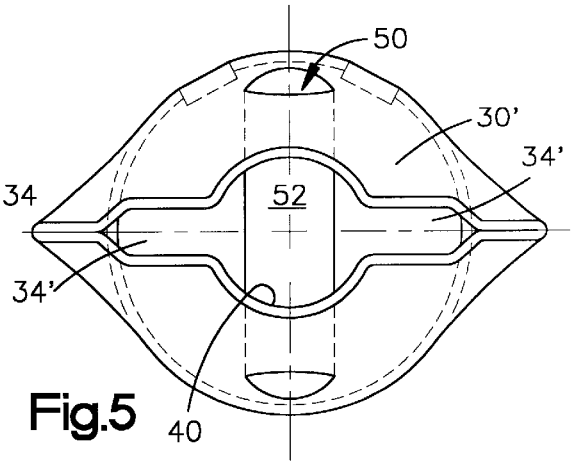
Figure 6:
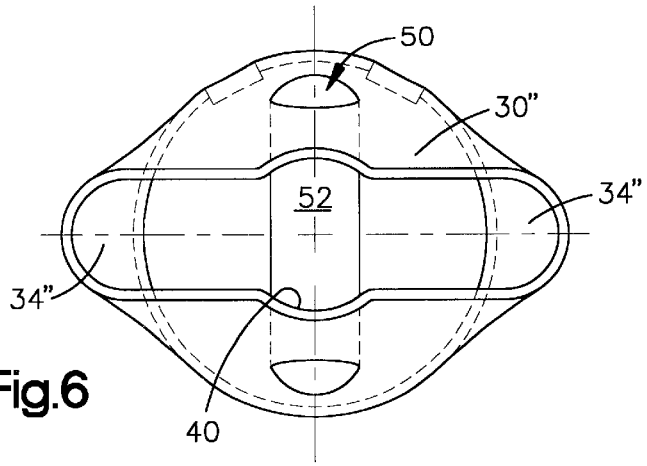

In the preferred and illustrated embodiment, a circular, gas orifice support 40 is integrally formed in the inlet end 30 of the tube 10*a* (shown best in FIGS. 4–6). The sizing of the circular portion 40 is adjusted to provide a significant gripping force on the orifice 32 when the orifice element 32 is inserted into the orifice support portion 40. In the preferred embodiment, the combustion air openings 34 extend laterally from either side of the support portion 40. The size of the openings 34 is adjusted during the crimping operation, since combustion air requirements vary depending on the type of gas to be used and the gas input rating. Preferably, the air openings are of a generally rectangular or ovular shape and have an aspect ratio (length/width) greater than 1.5 and a minimum dimension of 0.125".

FIGS. 5–6 illustrate alternately sized combustion air openings 34' and 34" which enable the burner to be used with alternate gas sources such as natural gas, propane gas, etc. or enable the burner to operate at an alternate gas input. The final size of the primary air openings 34 is determined by the type of gas to be used, the gas pressure and/or the gas flow rate sustained by the gas orifice 32. In accordance with the invention, conventional crimping or other metal forming operations are used to define the final cross-section of the combustion air end openings 34, 34' 34".

In accordance with a feature of the invention, a bluff body 50 is located immediately downstream from the orifice 32. Referring to FIGS. 3 and 4, the bluff body 50 may comprise a pin 52 extending vertically along a diametral line of the gas burner body log. As seen in FIGS. 4–6, the pin is centered with respect to the orifice holder portion 40, such that gas emitted by the orifice element 32 impinges on a central portion of the pin 52. The location of the pin 52 promotes mixing of the gas with the incoming combustion air. The region surrounding the pin 52 forms a mixing chamber As seen best in FIG. 2, linear patterns of adjacent flame ports are formed along the length of the burner 10*a*. In the illustrated embodiment, three rows of ports are formed in the tube boa and are arranged as follows. A first row of ports 70 extends substantially the full length of the burner body boa and is located to one side of a longitudinal center line 72. Positioned across the centerline in a parallel relationship with the row 70 are two longitudinally smaller row segments of flame ports 74, 76. The flame port row segments 74, 76 as seen in FIG. 2, are spaced apart but aligned with each other. As seen in FIG. 2, the arrangement of ports defines a region 78 on the burner body where flame ports are not formed. This region 78, as seen in FIG. 1, is aligned with the transverse log member 20.

The size of the port openings can vary and are determined during the manufacturing operation. The height of the flames emitted by each individual port is determined, at least in part, by the effective port opening.

Figure 7:
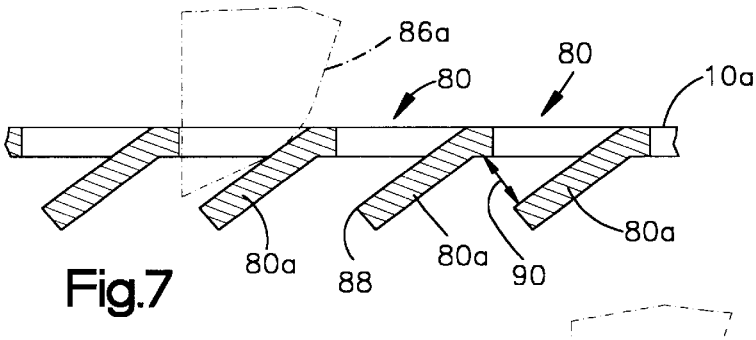
FIG. 7 is fragmentary sectional view of the burner as seen from plane indicated by the line 7—7 in FIG. 2.

Referring in particular to FIG. 7, the configuration of the individual ports is illustrated. The flame port rows 70, 72, 74 comprise a series of adjacent slot-like ports 80. In the preferred and illustrated embodiment, the ports are formed using a punching or "lancing" operation.

Figure 8:
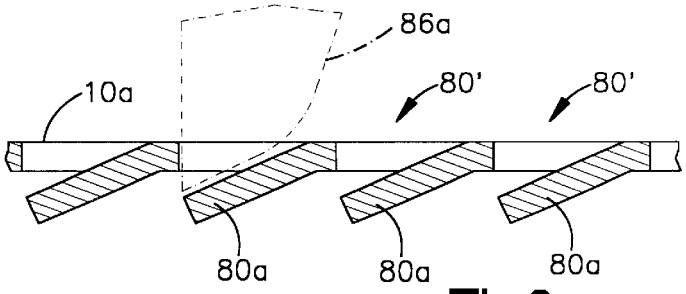
FIG. 8 is a fragmentary sectional view of the burner as seen from the line 8—8 in FIG. 2.

Referring to FIGS. 2, 7 and 8, the ports are formed as slots in the tube body 10*a*. Tabs 80*a* are formed during the punching operation and are bent downwardly by a tool 86 having a suitably formed tip 86*a* that shears the burner tube material along three edges, i.e., two side edges and a front edge. As seen best in FIGS. 7 and 8, the effective size of a port 80 is determined by the angle of adjacent tabs 80*a*. In effect, the adjacent tabs form a throat or channel through which the gas must travel. The effective port size of a port 80 is the distance between a lower edge 88 of a tab 80*a* and an adjacent tab as measured along a line orthogonal to an upper surface of the tab. This line is indicated in FIG. 7 by the reference character 90.

FIG. 8 illustrates ports 80' having a effective size that is smaller than the ports 80 shown in FIG. 7. In other words, for a given gas pressure the ports 80 shown in FIG. 7 will produce a larger flame height than the ports 80' shown in FIG. 8. The ports 80' effectively reduces flame height, and when used in connection with the ports 80 allow a full size flame for overall aesthetics while providing reduced flame height under crossing logs. In particular, the reduced flame height provided by the ports 80' prevents the flame from directly impinging on a crossing log which would otherwise cause sooting as well as provides carryover of flame at ignition between the full size flame regions.

In the illustrated embodiment, the combination of the smaller ports 80' and the portless region 78 result in a smaller overall flame segment below the log 20 and, hence, the potential for sooting is eliminated or substantially reduced. In short, the central portion of the burner has a smaller overall flame height or flame of less intensity as compared to the outer ends of the burner tube.

According to the preferred embodiment, the angle of the tabs in a given row of ports may vary. Referring in particular to FIG. 2, segments 70*a* of the flame port row 70 include the port configuration shown in FIG. 7.

A central segment 70*b* of the flame port row 70 is configured with the smaller ports 80' shown in FIG. 8. This disclosed configuration produces a smaller flame in the center of the burner. This is desirable since this region of the burner is below the transverse log 20. The ports 80 in the flame port rows 74, 76 are configured as in FIG. 7 and, as a result, produce a larger flame height. Other patterns of flames and flame heights can be produced by changing the angle to which the size defining tabs 80*a* are bent. In general, port arrangements (i.e. location and size) are selected to provide proper burning characteristics and aesthetics consistent with log set design.

As seen in FIGS. 9 and 10, the punching tool 86 having the piercing tip 86*a* can be used to "lance" the ports into the burner body 10*a*. The angle to which the resulting tabs 80*a* are bent is determined by the depth to which the punch tip 86*a* is driven.

FIGS. 11–14 illustrate an alternate embodiment of the invention. In this embodiment, the bluff pin 52 (shown in FIGS. 3–6) is replaced by a "dimple" that is formed in an inlet end 30' of a tube body 10*a*'. As seen best in FIG. 12, the inlet end 30' of the gas tube is formed with two confronting, substantially symmetrical depressions 100*a*, 100*b* which contact each other at a region indicated by the reference character 102 (FIG. 11) . A "bluff" structure indicated generally by the reference character 104 (FIG. 13) is thus formed directly downstream from a gas orifice 32'. As seen in FIG. 14, a pair of spaced apart, symmetrical passages 108 are formed to either side of the bluff structure 104. The disclosed construction forces the gas emitted by the orifice 32' to be split and diverted so that it flows through the spaced apart passages 108 where it is mixed with the incoming primary air. In effect the passages 104 form a mixing chamber. It has been found that this configuration which utilizes a formed bluff structure 104 with passages 108 to either side, provides an flame extinguishing function should "light back" occur in the burner. Those in the art will recognize that light back occurs when flame is drawn into the burner air inlet and ignites the gas/air mixture inside the burner tube. It has been found that a flame initiated by light back will not be sustained due to this inlet end configuration.

It has been found that the disclosed construction provides a very efficient and cost effective burner that is especially adapted to be used in artificial fireplaces. It has been found that the disclosed inlet arrangement allows a shorter distance between the first port and the gas inlet. Generally, in the past it was desirable to have the distance from the orifice to the first port to be at least 6 times the diameter of the burner body. With the disclosed configuration, it has been found that the first port may be at a distance 2½ times the diameter or less as measured from the gas discharge point on the gas orifice 32. This relatively short mixing chamber decreases the overall size of the burner while still providing sufficient mixing of the gas with the primary air, so that flame stability is maintained.

With the disclosed invention it has been found that the distance between the bluff body and the first flame port (the flame port closest to the gas orifice) may be 2 times the burner body diameter or less. The distance between the bluff body and the gas orifice may also be 2 times the tube diameter or less.

FIGS. 15 and 16 illustrate another embodiment of the invention. This third embodiment combines features of the first embodiment (FIGS. 1–11) and the second embodiment (FIGS. 12–14). In particular, the third embodiment includes a partial dimple construction, which is shown best in FIG. 16. A bluff structure indicated generally by the reference character 104' is formed downstream from a gas orifice (not shown). An inlet end 30" of a tube body 10*a*' is formed with two confronting, substantially symmetrical depressions 100*a*', 100*b*' which, unlike the embodiment of FIGS. 12–14 do not contact each other but instead contact and maintain the position of a cylindrical bluff element 120. The bluff 120 element may comprise a short cylindrical, tubular segment having opposite, open ends 120*a*, 120*b*. As seen best in FIG. 16, portions of the recesses 100*a*' and 100*b*' deform into the open ends 120*a*, 120*b* and thus, securely mount the bluff element 120. As seen best in FIG. 15, a pair of venturi channels 108' are thus formed on either side of the bluff element 120.

The combination of the tube or pin and dimples provides the advantage of a shortened mixing chamber as well as substantially eliminating light back.

Although the invention has been described with a certain degree of particularity, it should be understood that those skilled in the art can make various changes to it without departing from the spirit or scope of the invention as hereinafter claimed.

We claim:

1. A gas fireplace burner comprising:

a) an elongate, generally cylindrical sheet metal body, having an inlet end, a closed distal end and a tubular segment extending between said ends;

b) said distal end defining a mounting flange;

c) said inlet end being formed to define a gas orifice holder, said holder mounting a gas orifice element;

d) said inlet end further formed to define at least one primary air opening arranged to admit combustion air into said tubular segment;

e) a bluff body located downstream from said gas orifice element and positioned such that gas emitted by said orifice flows along a flow path and impinges on said bluff body, said bluff body formed at least partially by a one dimple formed near said inlet end that projects into said flow path, a center point of said dimple being located downstream of said orifice element; and, f) a series of flame ports defined in said tubular segment and arranged to create a desired, predetermined flame pattern.

2. The gas burner of claim 1, wherein said inlet end is formed with a second combustion air opening, said openings arranged such that said orifice holder is located intermediate said openings.

3. The gas burner of claim 2, wherein said bluff body is formed at least in part by a pin member extending along a diametral line of said tubular segment, said pin being located in a confronting relationship with respect to said gas orifice element and substantially centered with respect to said combustion air openings.

4. The gas burner of claim 1, wherein said flame ports are arranged in a linear pattern and at least some of said flame ports being slot-like in configuration and having an effective size determined by the orientation of a bent tab element that partially defines each of said ports.

5. The gas burner of claim 4, wherein said linear pattern of flame ports comprises three rows of adjacent slot-like openings.

6. The burner of claim 1, further comprising another dimple formed near said inlet that is positioned in a confronting relationship with said one dimple.

7. The burner of claim 6, wherein said confronting dimples are spaced apart and said bluff body further includes a bluff element positioned between said confronting dimples.

8. A gas fired artificial log assembly for a fireplace, comprising:

a) a log support structure;

b) a front non-combustible log member supported by said support structure and a rear non-combustible log member spaced rearwardly with respect to front combustible log member and supported by said support;

c) a gas burner located intermediate said front and rear log members, said gas burner comprising an elongate tubular body having one closed end and an inlet end;

d) said inlet end having an integrally formed gas orifice holder and at least one integrally formed combustion air opening located adjacent said orifice holder;

e) a gas orifice element held by said gas orifice holder and defining at least a portion of said combustion air opening; and, f) a bluff body located downstream from said gas orifice element, said bluff body formed by two spaced apart, confronting depressions formed near the inlet end of said burner body and a bluff element positioned between said confronting depressions and in an impinging relationship with respect to said gas orifice, such that gas emitted by said orifice element must travel around said bluff body and is thereby mixed with combustion air admitted through said combustion air openings.

9. The apparatus of claim 8, wherein said bluff element comprises a pin.

10. The apparatus of claim 8, wherein said inlet end defines a second combustion air opening aligned with, but spaced from, said first combustion air opening, such that said gas orifice element is located intermediate said combustion air openings and partially defines both of said openings.

11.The apparatus of claim 7, further comprising slot-like ports formed in at least one linear pattern in said burner body, said ports including a tab bent inwardly towards an interior region of said burner body, the angular displacement of said tabs determining the effective size of an associated port.

12. The apparatus of claim 11, wherein said depressions form a pair of internal venturi channels communicating with said combustion air openings, said venturi channels eliminating or substantially reducing the incidence of light back in said burner.

13. The apparatus of claim 12 wherein said venturi channels provide a mixing chamber.

14. The apparatus of claim 13 wherein said mixing chamber has a longitudinal extent such that the distance between the bluff element and a first port is 2.5 times the diameter of said tubular body or less.

15. The gas fired artificial log assembly of claim 8, wherein said bluff element comprises a tubular segment.

16. A gas fired artificial log assembly for a fireplace, comprising:

a) a log support structure;

b) a front non-combustible log member supported by said support structure and a rear non-combustible log member spaced rearwardly with respect to front combustible log member and supported by said support:

c) a gas burner located intermediate said front and rear log members, said gas burner comprising an elongate tubular body having one closed end and an inlet end;

d) said inlet end having an integrally formed gas orifice holder and at least one integrally formed combustion air opening located adjacent said orifice holder;

e) a gas orifice element held by said gas orifice holder and defining at least a portion of said combustion air opening; and, f) a bluff body located downstream from said gas orifice element, said bluff body being formed by two confronting depressions formed near the inlet end of said burner body, said depressions forming a pair of internal venturi channels communicating with said combustion air openings, said confronting depressions defining structure positioned in an impinging relationship with respect to said gas orifice, such that gas emitted by said orifice element must travel through said channels and is thereby mixed with combustion air admitted through said combustion air openings.

17. The gas fired artificial log assembly of claim 16, wherein said confronting depressions are spaced apart and said bluff body further includes a bluff element positioned between said confronting depressions.

18. The gas fired artificial log assembly of claim 17, wherein said bluff element is cylindrical.

19. The gas fired artificial log assembly of claim 17, wherein said bluff element is tubular.

20. A gas fireplace burner, comprising:

a) an elongate tubular body having one closed end and an inlet end;

b) a said inlet end having an integrally formed gas orifice holder and at least one integrally formed combustion air opening located adjacent said orifice holder;

c) it a gas orifice element held by said gas orifice holder and defining at least a portion of said combustion air opening; and, d) a bluff body located downstream from said gas orifice element and located in an impinging relationship with respect to gas emitted by said orifice element, said bluff body formed by two spaced apart, confronting depressions formed near the inlet end of said burner body and a bluff element positioned between said confronting depressions and in an impinging relationship with respect to said gas orifice, such that gas emitted by said orifice element must travel around said bluff element and is thereby mixed with combustion air admitted through said combustion air openings.

21. A gas burner, comprising:

a) an elongate tubular body having one closed end and an inlet end;

b) said inlet end including a gas orifice holder and at least one combustion air opening;

c) a gas orifice element held by said gas orifice holder; and, d) a bluff body located downstream from said gas orifice element, said bluff body being formed by two confronting depressions formed near the inlet end of said burner body, said depressions forming a pair of internal venturi channels communicating with said combustion air openings, said confronting depressions defining structure positioned in an impinging relationship with respect to said gas orifice, such that gas emitted by said orifice element must travel through said channels and is thereby mixed with combustion air admitted through said combustion air openings.

22. The gas burner of claim 21, wherein said confronting depressions are spaced apart and said bluff body further includes a bluff element positioned between said confronting depressions.

23. The burner of claim 22, wherein said bluff element is cylindrical.

24. The burner of claim 22, wherein said bluff element is tubular.

25. A gas fireplace burner comprising:

a) an elongate, generally cylindrical sheet metal body, having an inlet end, a closed distal end and a tubular segment extending between said ends;

b) said inlet end including a gas orifice holder that mounts a gas orifice element and at least one primary air opening arranged to admit combustion air into said tubular segment;

c) a bluff body located downstream from said gas orifice element and positioned such that gas emitted by said orifice impinges on said bluff body, said bluff body formed at least partially by a pair of confronting dimples formed near said inlet end, said dimples forming a pair of internal venturi channels communicating with said combustion air opening, such that gas emitted by said orifice element must travel through said channels and is thereby mixed with combustion air admitted through said combustion air opening; and, d) a series of ports defined in said tubular segment and arranged to create a desired, predetermined flame pattern.

* * * * *